US006717374B2

(12) United States Patent
Krummel

(10) Patent No.: US 6,717,374 B2
(45) Date of Patent: Apr. 6, 2004

(54) MICROCONTROLLER, SWITCHED-MODE POWER SUPPLY, BALLAST FOR OPERATING AT LEAST ONE ELECTRIC LAMP, AND METHOD OF OPERATING AT LEAST ONE ELECTRIC LAMP

(75) Inventor: Peter Krummel, Traunreut (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/041,646

(22) Filed: Jan. 10, 2002

(65) Prior Publication Data

US 2002/0097008 A1 Jul. 25, 2002

(30) Foreign Application Priority Data

Jan. 23, 2001 (DE) ..... 101 02 940

(51) Int. Cl.[7] ..... H05B 37/02
(52) U.S. Cl. ..... 315/291; 315/194
(58) Field of Search ..... 315/291, 307, 315/209 R, 308, 224, 105, 106, DIG. 4, DIG. 5, DIG. 7

(56) References Cited

U.S. PATENT DOCUMENTS 5,569,984 A * 10/1996 Holtslag ..... 315/307
5,680,015 A * 10/1997 Bernitz et al. ..... 315/291
5,691,605 A * 11/1997 Xia et al. ..... 315/307
5,828,187 A * 10/1998 Fischer ..... 315/291
5,872,429 A * 2/1999 Xia et al. ..... 315/194
6,137,240 A * 10/2000 Bogdan ..... 315/307
6,259,215 B1 * 7/2001 Roman ..... 315/307

FOREIGN PATENT DOCUMENTS

EP 0 708 579 B1 10/1994

* cited by examiner

*Primary Examiner*—James Clinger
*Assistant Examiner*—Chuc Tran

(57) ABSTRACT

The invention relates to a microcontroller (MC) having at least one device (G) for generating pulse-width modulated or frequency modulated control signals for a switched-mode power supply. The device (G) has a further device (SQ1, SS1) for the alternate charging and discharging an electric charge store (C27) that can be connected to the microcontroller (MC), control means for this device (SQ1, SS1) for controlling the charging and discharging operations, and an evalutor for evaluating the time periods which are needed for the individual charging and discharging operations to generate pulse-width modulated or frequency modulated control signals. The microcontroller (MC) generates finely graduated, frequency modulated or pulse-width modulated control signals which are independent of the operating cycle frequency of the microcontroller (MC).

29 Claims, 7 Drawing Sheets

MICROCONTROLLER, SWITCHED-MODE POWER SUPPLY, BALLAST FOR OPERATING AT LEAST ONE ELECTRIC LAMP, AND METHOD OF OPERATING AT LEAST ONE ELECTRIC LAMP

The invention relates to a microcontroller according to the preamble of patent claim 1, a switched-mode power supply according to patent claim 10, a ballast for at least one electric lamp according to the preamble of patent claim 11, and a method of operating at least one electric lamp according to the preamble of patent claim 25.

I. TECHNICAL FIELD

In particular, the invention relates to a microcontroller which is provided to drive the switching transistors of a switched-mode power supply, to be specific preferably of a switched-mode power supply for operating electric lamps. In the switched-mode power supplies normally used to operate electric lamps, there are normally inverters, in particular half-bridge, full-bridge and push-pull inverters, and also step-up converters and step-down converters. Modern electronic ballasts for operating electric lamps generally have an inverter to produce a high-frequency alternating current for lamp operation and often also have a step-up converter as a DC supply for the inverter. The switching transistors of the inverter and of the step-up converter are driven by means of driver circuits, which are constructed as integrated circuits designed using analog techniques. In addition, modern electronic ballasts for electric lamps also contain a microcontroller, which is generally used for communication with a control unit arranged outside the ballast and for evaluating the control commands from this control unit for lamp operation and also for monitoring the lamp operation.

II. PRIOR ART

The European publication EP 0 708 579 A1 discloses a circuit arrangement for operating a high-pressure discharge lamp using an inverter, whose switching transistors have pulse-width modulated control signals applied to them by means of a microcontroller and a downstream integrated driver circuit. The pulse-width modulated control signals are generated with the aid of the auto-reload timer implemented in the microcontroller. In principle, this is a counting mechanism which operates at the operating cycle frequency of the microcontroller. During the counting operation, the reaching of a reference value and the overflow of the counting mechanism are monitored. During the time period which is needed to reach the reference value, the output of the auto-reload timer is at the "high" logic level, and during the time period which the counting mechanism needs to count up from the reference value until the counter overflows, the output of the auto-reload timer is at the "low" logic level. In this way, with the aid of the microcontroller, pulse-width modulated control signals for the inverter are generated, in order to permit lamp operation with a frequency-modulated voltage in a small frequency range and with a comparatively low number of discrete frequencies.

However, in this way, using cost-effective microcontrollers, no finely graduated pulse-width modulation control nor any finely graduated frequency control of the inverter can be carried out, since the smallest possible, adjustable change in the pulse width or in the frequency of the control signal which can be generated by the counting mechanism explained above is limited by the operating cycle frequency of the microcontroller and by the memory size of the counting mechanism. In order, for example, to permit dimming operation of fluorescent lamps on an electronic ballast by means of frequency modulation of the lamp current, frequency changes in steps of approximately 50 Hz are required in the frequency range from about 30 kHz to 100 kHz. If this frequency modulation is to be generated with the aid of the auto-reload timer, a microcontroller with an operating cycle frequency of more than 100 MHz is needed for this purpose. However, for cost reasons, such microcontrollers cannot be used in electronic ballasts for lamp operation.

III. SUMMARY OF THE INVENTION

It is an object of the invention to provide a microcontroller with an improved device for pulse-width modulation control and/or frequency control of a switched-mode power supply.

A further object of the invention is to provide a switched-mode power supply provided with a microcontroller with improved driving of the switching means of the switched-mode power supply.

In addition, it is an object of the invention to provide a ballast equipped with an inverter for operating at least one electric lamp which, with the aid of a microcontroller, permits finely graduated frequency control and/or pulse-width modulation control of the switching means of the inverter.

Furthermore, it is an object of the invention to specify an improved method for generating frequency control signals and/or pulse-width modulation control signals for the switching means of an inverter of a ballast for operating electric lamps by means of a microcontroller.

The aforementioned objects of the invention are achieved by the features of the independent patent claims 1, 10, 11 and 25, respectively. Advantageous refinements of the invention are described in the dependent patent claims.

The microcontroller according to the invention has at least one device for pulse-width modulation control and/or frequency control of a switched-mode power supply, this device having

- a device for the alternate charging and discharging of a charge store that can be connected to the microcontroller or integrated into the microcontroller,
- control means for the device for controlling the charging operations and/or the discharging operations, and
- evaluation means which are used to evaluate the time periods required for recharging the charge store between different charge states and, on this basis, to generate a pulse-width modulation control signal and/or frequency control signal.

The device for the alternate charging and discharging of a charge store, and its control means, permit controlled charging operations and discharging operations to be carried out alternately with each other on a charge store and, with the aid of the evaluation means, the evaluation of the time periods which are needed for the partial charging and discharging of the charge store and on this basis the generation of a pulse-width modulation control signal and/or frequency control signal. Even if the microcontroller according to the invention has only a low operating cycle frequency, it can be used to implement finely graduated pulse-width modulation control and/or frequency control of a switched-mode power supply, since the device for the alternate charging and discharging of a charge store operates independently of the operating cycle frequency of the microcontroller.

The device for the alternate charging and discharging of a charge store advantageously comprises a controllable current source for applying an adjustable charging current to the charge store, and a controllable current sink for applying an adjustable discharging current to the charge store. As a result, the individual charging and discharging operations can be controlled independently of one another. In addition, the controllable current source and current sink can be produced in a known way by means of semiconductor technology and integrated into the microcontroller. In order to permit very fine graduation of the pulse-width modulation control signals and/or frequency control signals, the controllable current source and the controllable current sink are formed in such a way that their settings can be varied in relation to a reference current level, in each case with a resolution of at least 8 bits. The reference current level for the charging and the discharging current is in this case advantageously predefined with the aid of a nonreactive resistor. The control means provided for the device for the alternate charging and discharging of a charge store is advantageously at least one read/write memory. The content of the read/write memory can be updated continuously, for example under program control, and can be read in order to control the device for the alternate charging and discharging of a charge store. The control means advantageously comprise a switching means which are used to switch over the device for the alternate charging and discharging of a charge store from charging to discharging of the charge store when a first voltage value is reached, and to switch over the device for the alternate charging and discharging of a charge store from discharging to charging of the charge store when a second, lower voltage value is reached. With the aid of the switching means, the device for the alternate charging and discharging of a charge store is simply forced into mutually alternating charging and discharging operations, so that the charge state of the charge store is subjected to an incessant oscillation, which can be evaluated in order to generate frequency control signals and/or pulse-width modulation control signals. The first or the second voltage value can advantageously be adjusted by means of a read/write memory. As a result, the aforementioned oscillation of the charge state of the charge store can be influenced under program control.

The microcontroller according to the invention advantageously has a frequency divider or a pulse divider which, at its input, detects the changeover of the device for the alternate charging and discharging of a charge store from discharging to charging or from charging to discharging and divides the input signal into signals for the alternating control of alternately switching means of the switched-mode power supply. With the aid of the frequency divider or pulse divider, the oscillation of the charge state of the charge store can be evaluated in order to generate frequency control signals and/or pulse-width modulation control signals for the switching means of a switched-mode power supply with alternately switching means.

The microcontroller according to the invention additionally advantageously has interfaces for registering external signals or data and has a device for evaluating the external signals or data and for the program-controlled determination of actuating values for controlling the device for the alternate charging and discharging of a charge store. As a result, a control loop for the oscillation of the charge state of the charge store can be implemented on the basis of external operating parameters and the actuating values derived therefrom.

The switched-mode power supply according to the invention is distinguished by a microcontroller as claimed in one or more of claims 1 to 9. As distinguished from the previously conventional switched-mode power supplies, in the case of the switched-mode power supply according to the invention, the signals for pulse-width modulation or for frequency control of the switching transistors of the switched-mode power supply are generated by the microcontroller. The corresponding control signals are forwarded to the control electrodes of the switching transistors of the switched-mode power supply from the microcontroller, directly or if appropriate via driver circuits. As has already been mentioned above, these control signals are independent of the operating cycle frequency of the microcontroller.

The ballast according to the invention for operating at least one electric lamp has an inverter, at least one load circuit coupled to the inverter and having terminals for the at least one electric lamp, a control circuit for controlling the switching means of the inverter and a DC supply circuit for the inverter, the control circuit comprising a microcontroller having a device for pulse-width modulation control and/or frequency control of the switching means of the inverter. According to the invention, the device for pulse-width modulation control and/or frequency control of the switching means of the inverter has

- a device for the alternate charging and discharging of a charge store,
- control means for the device for the alternate charging and discharging of the charge store, which are used to control the charging operations and/or the discharging operations, and
- evaluation means, which are used to evaluate the duration of the alternate charging and discharging operations of the charge store and on this basis to generate a frequency control signal and/or a pulse-width modulation control signal for controlling the switching means of the inverter.

The device for the alternate charging and discharging of a charge store, the charge store and the control means for the device for the alternate charging and discharging of a charge store form an oscillator, which operates independently of the operating cycle frequency of the microcontroller. The oscillations of the charge state of the charge store are evaluated with the aid of the evaluation means in order to generate frequency control signals and/or pulse-width modulation control signals for the inverter.

As a result of the aforementioned features of the ballast according to the invention, it becomes possible, with the aid of a relatively simple and cost-effective microcontroller, to implement all the essential control functions of a modern, dimmable ballast. In particular, these are the power factor correction, the control of the inverter, the control of the lamp electrode heating, the regulation of the load circuit, the brightness control of the lamps and monitoring of the lamp operation. As compared with previously conventional ballasts, which either have a freely oscillating inverter or an inverter controlled externally by means of an integrated circuit, and are able to ensure monitoring of the lamp operation only with numerous additional components, the ballast according to the invention manages with comparatively few additional components. Most functions in the ballast according to the invention are performed by the microcontroller. For example, end-of-life monitoring of the lamp can be implemented particularly simply with the ballast according to the invention, but is very complicated and expensive in ballasts according to the prior art.

For the alternate control of the switching means of the inverter, the device for pulse-width modulation control and/or frequency control advantageously has a frequency divider or a pulse divider which, at its input, detects the changeover of the device for the alternate charging and discharging of a charge store from discharging to charging or from charging to discharging of the charge store, and divides the input signal into signals for the alternating control of the switching means of the inverter.

In order to apply a heating current to the lamp electrodes, the ballast according to the invention advantageously has a heating device equipped with a controllable switching means, and the microcontroller has a comparator, which compares the charge state of the charge store with a reference value for the lamp electrode heating and which is used to generate a control signal for the pulse-width modulation of the controllable switching means of the heating device. As a result, the oscillation of the oscillator mentioned above can be evaluated not only for the purpose of controlling the inverter but additionally for the regulation of the heating current for the lamp electrodes. The reference value for the lamp electrode heating is advantageously adjustable by means of a read/write memory, in order to be able to adapt the heating current for the lamp electrodes to the different operating states of the lamp. The microcontroller additionally advantageously has synchronization means for synchronizing the controllable switching means of the heating device with a switching means of the inverter. As a result, driving the switching means of the heating device is simplified. In addition, the oscillatory behavior of the inverter is influenced positively as a result.

In the ballast according to the invention, the DC supply circuit of the inverter advantageously has a step-up converter for power factor correction and/or to achieve a most sinusoidal mains current consumption, and the microcontroller is equipped with a second device for the alternate charging and discharging of a second charge store, and also with second control means for this second device for controlling the charging and/or discharging operations. The second device for the alternate charging and discharging of a charge store, the second charge store and the second control means for this second device form a second oscillator, which likewise operates independently of the operating cycle frequency of the microcontroller. The microcontroller is additionally equipped with second evaluation means, which are used to evaluate the oscillations of the charge state of the second charge store in order to produce pulse-width modulation control signals and/or frequency control signals for the controllable switching means of the step-up converter. In particular, the time periods required for recharging the second charge store between different charge states are evaluated for this purpose. The microcontroller therefore additionally performs the control of the step-up converter as well.

In order to evaluate the oscillations of the charge state of the second charge store to produce pulse-width modulation control signals and/or frequency control signals, the second evaluation means advantageously have a first comparator to compare the charge state of the second charge store with a first voltage value, and a second comparator to compare the charge state of the second charge store with a second, lower voltage value, and the second control means advantageously have switching means which are used to switch over the second device for the alternate charging and discharging of a charge store from charging to discharging of the second charge store when the first voltage value is reached, and to switch over the second device for the alternate charging and discharging of a charge store from discharging to charging of the second charge store when the second, lower voltage value is reached. The first or the second voltage value can advantageously be adjusted by means of a read/write memory. As a result, the first or second voltage value can be varied, for example by means of a program executed by the microcontroller, and can be stored in order to control the second device for the alternate charging and discharging of a charge store.

The two devices for the alternate charging and discharging of a charge store advantageously in each case have a controllable current source for applying an adjustable charging current to the charge store and the second charge store, and in each case a controllable current sink for applying an adjustable discharging current to the charge store and, respectively the second charge store. The controllable current sources and current sinks may be produced in a known manner with the aid of semiconductor technology and integrated into the microcontroller. As a result, the two devices for the alternate charging and discharging of a charge store can be produced with simple means as a constituent part of the microcontroller. In order to ensure fine graduation of the frequency control signals or the pulse-width modulation control signals, the settings of the controllable current sources and current sinks can be varied in relation to a reference current level, in each case with a resolution of at least 8 bits. The aforementioned reference current level for the charging current and the discharging current can advantageously be predefined by means of a nonreactive resistor. This makes it possible to adapt the control of the inverter to different mains voltages by means of appropriate dimensioning of the nonreactive resistor. In order to save components, it is additionally preferable for only a single nonreactive resistor to be used to predefine the same reference current level for the charging and discharging currents of the two charge stores.

The microcontroller of the ballast according to the invention advantageously has at least one status bit which can be set and reset and via which the at least one controllable switching means of the inverter can be activated and deactivated. With the aid of this status bit, the inverter can be switched off in a simple way in the event of a defective lamp or during end-of-life monitoring of the lamp. Instead, of course, it is also possible for the controllable switching means of the step-converter and therefore the voltage supply to the inverter to be deactivated by means of the status bit, in order in a simple way to implement safety shutdown of the ballast. The microcontroller advantageously has one or more further status bits which can be set and reset, in order to be able to switch the pulse-width modulation control of the step-up converter or of the inverter off or on as desired. As a result, it is possible to apply only frequency control signals or pulse-width modulation control signals or frequency signals and pulse-width modulation control signals as desired to the controllable switching means of the step-up converter and of the inverter.

The microcontroller of the ballast according to the invention is advantageously provided with interfaces for registering operating parameters of the step-up converter or of the inverter or of the at least one electric lamp, in order, by means of a program-controlled device belonging to the microcontroller, to evaluate the operating parameters and to generate actuating values for controlling the devices for the alternate charging and discharging of a charge store, or to determine the reference value for the lamp electrode heating or the first or second reference value for the control of the step-up converter. The microcontroller is preferably provided with interfaces for registering at least one operating parameter of the step-up converter, of the inverter and of the load circuit or the at least one electric lamp. As a result, control loops can be built up for the step-up converter, the inverter and the load circuit with the lamp.

The ballast according to the invention advantageously has terminals and means for communication with an externally arranged control device, which are in turn connected to interfaces of the microcontroller. As a result, the ballast according to the invention is prepared to receive and process control commands from an external control device and to emit status messages to the external control device. These processes are likewise monitored by the microcontroller of the ballast according to the invention.

According to the invention, the method according to the invention of operating at least one electric lamp on a ballast which has an inverter with a control circuit containing a microcontroller for the switching means of the inverter and at least one load circuit coupled to the inverter and having terminals for the at least one lamp, is distinguished by the fact that, with the aid of the microcontroller, a charge store has a charging current and a discharging current alternately applied to it, and the duration of the alternate charging and discharging operations of the charge store is evaluated and on this basis a frequency control signal and/or a pulse-width modulation control signal for the alternating control of the switching means of the inverter is generated. The method according to the invention makes it possible, irrespective of the operating cycle frequency of the microcontroller, to generate control signals for frequency control and/or for pulse-width modulation of the inverter, with the aid of the microcontroller. As a result, a comparatively cost-effective microcontroller, that is to say a microcontroller with a low operating cycle frequency, can be used in the ballast according to the invention in order to implement all the essential control functions.

In order to drive the switching means of the inverter alternately, use is advantageously made of a frequency divider or a pulse divider, which detects the changeover of the device for the alternate charging and discharging of a charge store from discharging to charging of the charge store or from charging to discharging of the charge store.

The method according to the invention also permits heating of the lamp electrodes, by the heating current for the lamp electrodes being regulated by means of a controllable switching means. The signals for the pulse-width modulated control of the controllable switching means of the heating device are advantageously generated with the aid of a comparator, which compares the charge state of the charge store with a reference value for the lamp electrode heating. In this way, frequency control signals and/or pulse-width modulation control signals can be generated both for the switching means of the inverter and for the controllable switching means of the heating device, by the duration of the charging and discharging operations of the charge store being evaluated. The reference value for the lamp electrode heating is advantageously set on the basis of the desired heating power and stored in a read/write memory of the microcontroller. As a result, the heating power can be set under program control by means of the microcontroller. In addition, the controllable switching means for regulating the heating current are advantageously switched on synchronously with a switching means of the inverter. This simplifies the driving of the controllable switching means of the heating device. The duty cycle of the controllable switching means for regulating the heating current is preferably smaller than or equal to the duty cycle of the corresponding switching means of the inverter.

The DC supply to the inverter is regulated with the aid of a step-up converter, in order to ensure power factor correction and/or a sinusoidal mains current consumption. The pulse-width modulation control signals and/or the frequency control signals for the controllable switching means of the step-up converter are likewise advantageously generated with the aid of the microcontroller, by a second charge store being recharged between different charge states, and the time periods for recharging the second charge store being evaluated in order to generate the pulse-width modulation control signals and/or the frequency control signals for the controllable switching means of the step-up converter. The same microcontroller as is used to control the inverter can in this way also be used to control the step-up converter. The recharging of the second charge store can be detected and evaluated in a simple way by means of two comparators, by the first comparator comparing the charge state of the second charge store with a first voltage value, and the second comparator comparing the charge state of the second charge store with a second, lower voltage value. When the first voltage value is reached, the charging operation is terminated and the discharging operation of the second charge store is started, while when the second, lower voltage value is reached, the discharging operation is terminated and the charging operation of the second charge store is restarted anew. The first or second voltage value is advantageously set by means of a read/write memory. As a result, the corresponding voltage value can be varied under program control.

Advantageously, with the aid of the microcontroller, actual values of operating parameters of the inverter and/or of the DC supply circuit of the inverter and/or of the at least one electric lamp are monitored and evaluated in order to control the charging or discharging operations of the charge store and/or to determine the reference value for the lamp electrode heating and/or to determine the first and/or second voltage value. As a result, control loops for controlling the inverter and its DC supply and also for the lamp electrode heating can be implemented.

IV. BRIEF DESCRIPTION OF THE DRAWINGS

V. DETAILED DESCRIPTION OF PREFERRED EMBODIMENTS

Figure 1:
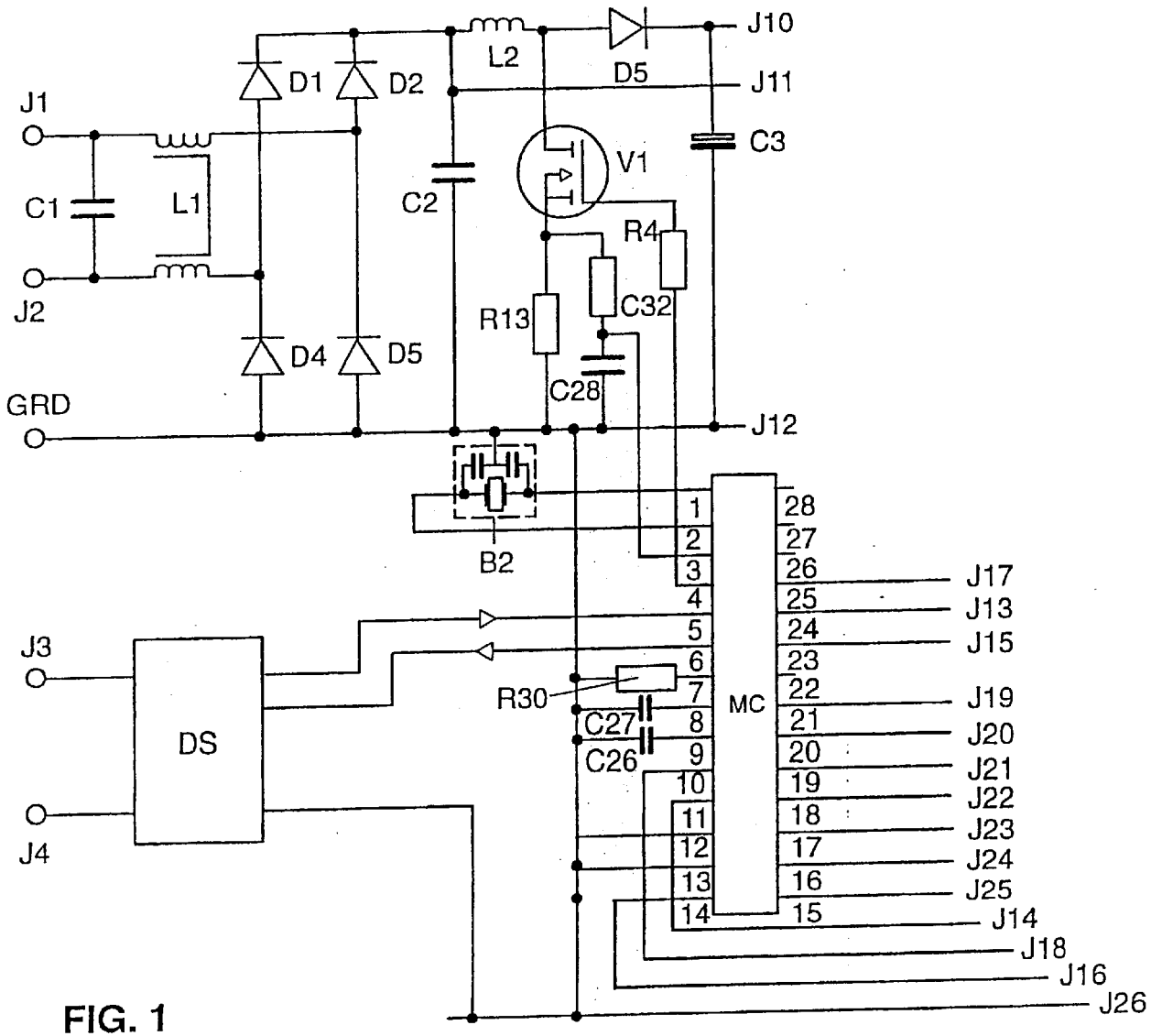
FIG. 1 shows a schematic illustration of the first half of the circuit arrangement according to the preferred exemplary embodiment of the ballast according to the invention.
Figure 2:
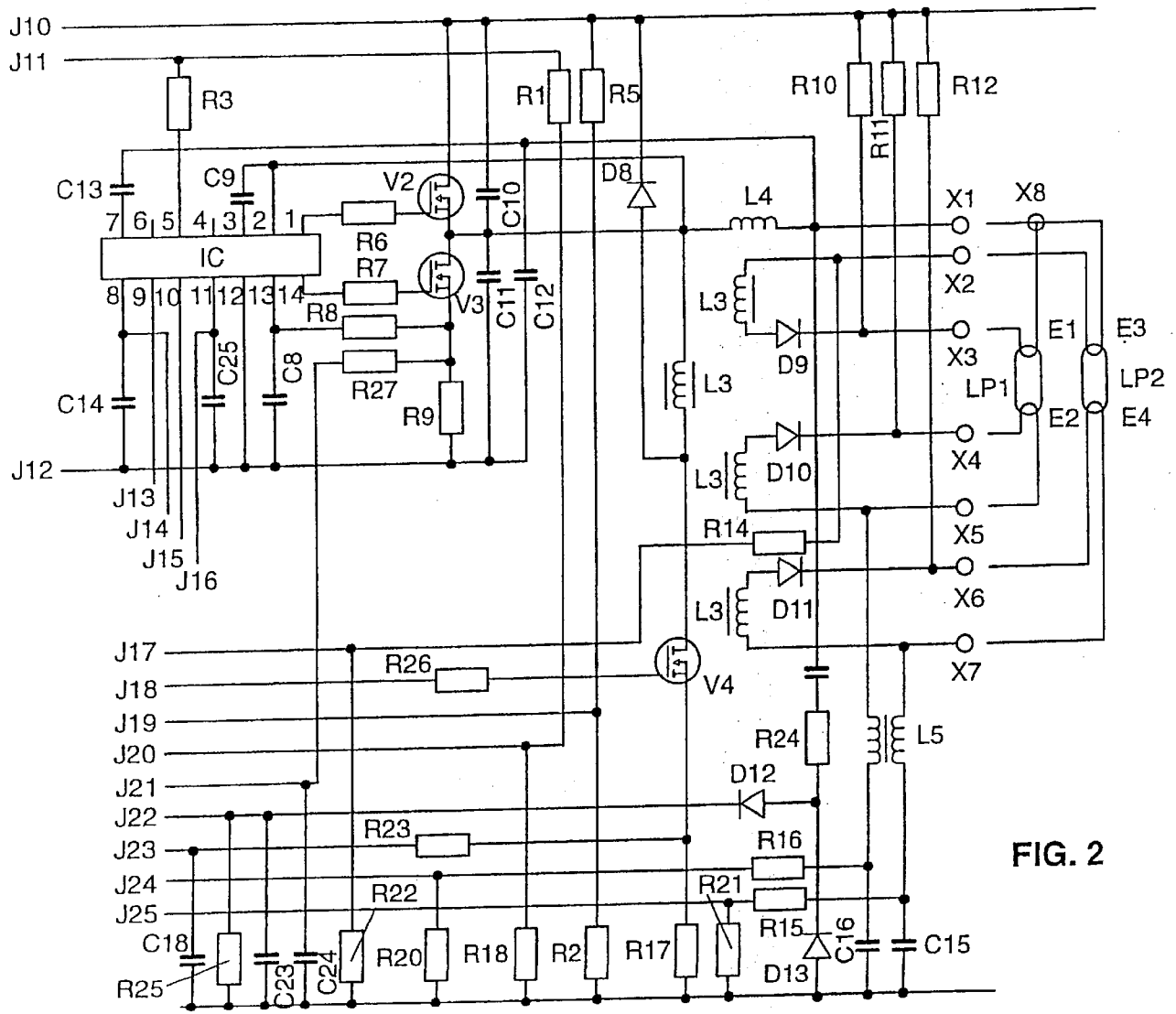
FIG. 2 shows a schematic illustration of the second half of the circuit arrangement according to the preferred exemplary embodiment of the ballast according to the invention.

The circuit arrangement of the preferred exemplary embodiment of the ballast according to the invention is illustrated schematically in FIGS. 1 and 2. Because of its size, the circuit arrangement has had to be illustrated on two sheets. The two halves of the circuit arrangement, depicted in FIGS. 1 and 2, are linked to each other at the connecting points designated by J10 to J26. This ballast is an electronic ballast, as it is known, for operating fluorescent lamps. The ballast has two mains voltage terminals J1, J2, to which a filter circuit, comprising the capacitor C1 and the transformer L1, is connected to suppress radio interference from the ballast. This filter circuit is connected to a bridge rectifier, which is formed by four rectifier diodes D1, D2, D3 and D4. Connected downstream of the bridge rectifier D1–D4 is the capacitor C2, which forms the DC output of the bridge rectifier D1–D4. Connected to the capacitor C2 is a step-up converter, which comprises the field effect transistor V1, the inductor L2, the diode D5 and the resistor R13. The DC voltage present across the capacitor C2 is used as a supply voltage for the step-up converter. The gate electrode of the transistor V1 is connected via the resistor R4 to the pin 4 of the microcontroller MC, which performs the control of the transistor V1. The voltage output from the step-up converter is formed by the intermediate circuit capacitor C3. The voltage across the intermediate circuit capacitor C3 is monitored by means of the voltage divider resistors R2, R5 on pin 21 of the microcontroller MC. In addition, in order to control the transistor V1, the voltage across the capacitor C2 is also detected with the aid of the voltage divider resistors R1, R18 on pin 20 of the microcontroller MC.

Across the intermediate circuit capacitor C3, a smoothed DC voltage is provided in order to supply the half-bridge inverter connected downstream. The half-bridge converter substantially comprises the field effect transistors V2, V3, the snubber capacitors C10, C11, the inductor L4, the coupling capacitors C15, C16 and the firing capacitor C12. Connected to the center tap between the two transistors V2, V3 of the inverter is a load circuit, which comprises the inductor L4, the firing capacitor C12, the terminals X1 to X8 for the electrode filaments E1, E2 and E3, E4 of the two parallel connected fluorescent lamps LP1, LP2, the transformer L5 and the coupling capacitors C15, C16. The firing capacitor C12 is connected in parallel with the two lamps LP1, LP2. The coupling capacitors C15, C16 are in each case arranged in series with one of the lamps LP1, LP2. The transformer L5 is used to balance the currents in the lamp circuits. For this purpose, in each case one of the transformer windings is arranged in one of the lamp circuits, that is to say in series with one of the lamps LP1, LP2. The two lamp circuits are combined again at the terminal X8 and at the two terminals of the coupling capacitors C15, C16 connected to the internal circuit ground GRD. The gate electrodes of the transistors V2, V3 are controlled by the microcontroller MC, via the resistors R6 and R7, with the aid of the integrated circuit IC, which substantially only has driver circuits for driving the inverter transistors and circuits for generating auxiliary voltages for the microcontroller MC. In the load circuit for the lamps LP1, LP2, the half-bridge inverter generates a high-frequency current at a frequency between about 30 kHz and 100 kHz. After the gas discharge in the lamps LP1, LP2 has been fired, high-frequency lamp currents flow in the two lamp circuits, via the terminal X8, the discharge path of the lamp LP1 and LP2, the terminal X5 and X7 and via the coupling capacitors C16 and C15. The inductor L4 and the firing capacitor C12 are designed as a series resonant circuit. The firing voltage required to fire the gas discharge in the fluorescent lamps is provided by the resonant peak method on the firing capacitor C12, by the switching frequency of the transistors V2, V3 of the half-bridge inverter being brought close to the resonant frequency of the series resonant circuit during the firing phase. The center tap between the inductor L4 and the firing capacitor C12 is connected to pin 18 of the microcontroller MC via the capacitor C22, the resistor R24 and the diode D12 polarized in the forward direction. A half wave belonging to the alternating current component of the load current is monitored on pin 18 by means of the resistors R24, R25, the diodes D12, D13 and the capacitors C22, C23. The other half wave of the alternating current component of the current flowing in the load circuit is clamped to the internal circuit ground potential GRD by the diode D13. Pin 19 of the microcontroller MC is connected via the resistor R27 to the source electrode of the transistor V3 and, via the capacitor C24, is coupled to the internal circuit ground potential GRD. The resistor R9 connects the source electrode of the transistor V3 to the internal circuit ground potential GRD. The current through the transistor V3 is monitored at pin 19.

The ballast also has a heating device for the electrodes E1–E4 of the two fluorescent lamps, which is connected to the center tap between the two field effect transistors V2, V3 of the half-bridge inverter. This heating device substantially comprises the field effect transistor V4 and the transformer L3. The primary winding of the transformer L3 is connected on one side to the center tap between the transistors V2, V3 and on the other side to the drain terminal of the transistor V4 and also, in the DC forward direction, via the diode D8 to the positive pole of the intermediate circuit capacitor C3. The source electrode of the transistor V4 is connected via the resistor R17 to the internal circuit ground potential GRD. The three secondary windings of the transformer L3, when lamps LP1, LP2 are connected, are in each case arranged together with a rectifier diode D9 or D10 or D11 in a closed circuit for heating the electrode filaments E1 and E3 and the electrode filament E2 or E4. The heating current in the three heating circuits fitted with the secondary windings of the transformer L3 is regulated by the switching cycle of the transistor V4. In order to control the switching cycle of the transistor V4, its gate electrode is connected via the resistor R26 to pin 10 of the microcontroller MC. The heating device is used firstly to preheat the electrode filaments E1–E4 before the gas discharge in the lamps LP1, LP2 is fired, and secondly for heating the electrode filaments E1–E4 during dimming operation of the lamps LP1, LP2. The heating current, that is to say the current through the primary winding of the transformer L3 and through the transistor V4, is monitored with the aid of the RC element R23, C18 on pin 17 of the microcontroller MC. For this purpose, pin 17 is connected to the source electrode of the transistor V4 via the resistor R23.

With the aid of the resistor R10 and the diode D9, a direct current path is implemented which, starting from the positive pole of the capacitor C3, is led via the resistor R10, the terminal X3, the electrode filament E1, the terminal X8, the electrode filament E3, the terminal X2 and via the resistors R14, R22 to the internal circuit ground potential GRD. This direct current path is interrupted if one of the lamps LP1 or LP2 is missing or one of the electrode filaments E1 or E3 is defective. The center tap between the resistors R14, R22 is connected to pin 25 of the microcontroller MC, in order to monitor the direct current path. Two further direct current paths are implemented with the aid of the resistor R11 and R12 and the diodes D10 and D11 and also the resistors R16, R20 and R15, R21, in order to monitor the electrode filaments E2 and E4. A rupture of the electrode filament E2 or E4 is detected at pin 16 or 15 by the microcontroller MC via the corresponding winding of the transformer L5 and via a resistor R16 or R15. In addition, by means of the voltage divider resistors R15, R21 and R16, R20, the current through the lamp LP1 and LP2 or the voltage drop across the coupling capacitor C15 or C16 is also monitored on pin 15, 16 of the microcontroller MC, in order to detect the rectifying effect of the lamp LP1 or LP2 that occurs at the end of the lifetime of the lamp LP1 or LP2.

The ballast additionally has a communication device DS for communication with an external control device (not depicted). This device DS has two terminals J3, J4, which can be connected to the external control device. The terminals J3, J4 are used to receive digital or analog control signals from the external control device and to transmit information, for example about the operating state of the lamps, from the ballast to the external control device. A bidirectional connection to the external control device is possible via the terminals J3, J4. One output of the communication device DS is connected to the internal circuit ground potential GRD. Pin 6 of the microcontroller MC is connected to the input to the communication device DS in order to transmit data to the external control unit, and pin 5 of the microcontroller MC is connected to the output from the communication device DS in order to receive and to evaluate control commands from the external control device.

The integrated circuit IC contains driver circuits for the transistors V2, V3, in particular a bootstrap circuit for the transistor V2 and level-shift circuits for controlling the transistors V2, V3. The capacitor C9 and the pins 1, 2, 3 and 14 of the integrated circuit IC are assigned to these driver circuits of the transistors V2, V3. The control signals for regulating the switching cycle of the transistors V2, V3 and for the frequency control of the half-bridge inverter are generated by the microcontroller MC and supplied to pin 9 and 10 of the integrated circuit IC via pin 24 and 23, respectively. With the aid of the resistor R8, which connects pin 13 of the integrated circuit IC to the source terminal of the transistor V3, and the capacitor C8, via which pin 13 of the integrated circuit IC is coupled to the ground potential GRD, a detector is implemented which prevents excessively high current loading of the transistors V2, V3. Via the resistor R3, pin 5 of the integrated circuit IC is connected to the positive pole of the capacitor C2. During the starting phase, that is to say before the half-bridge inverter has started its oscillation, a voltage supply for the integrated circuit IC is ensured via pin 5. On pins 8 and 11 of the integrated circuit IC, with the aid of the capacitors C14 and C25, auxiliary voltages of 5 V and 15 V for the microcontroller MC are provided. As long as the half-bridge inverter oscillates, the voltage for supplying the integrated circuit IC and the microcontroller MC is derived from the load circuit by means of the capacitor C13 connected to pin 7 of the integrated circuit IC and to the center tap between the firing capacitor C12 and the inductor L4, and by means of a two-point regulator integrated in the integrated circuit IC.

In the following text, the construction of the microcontroller MC and the generation of the control signals for the transistors V1–V4 with the aid of the microcontroller MC will be explained in more detail.

Figure 3:
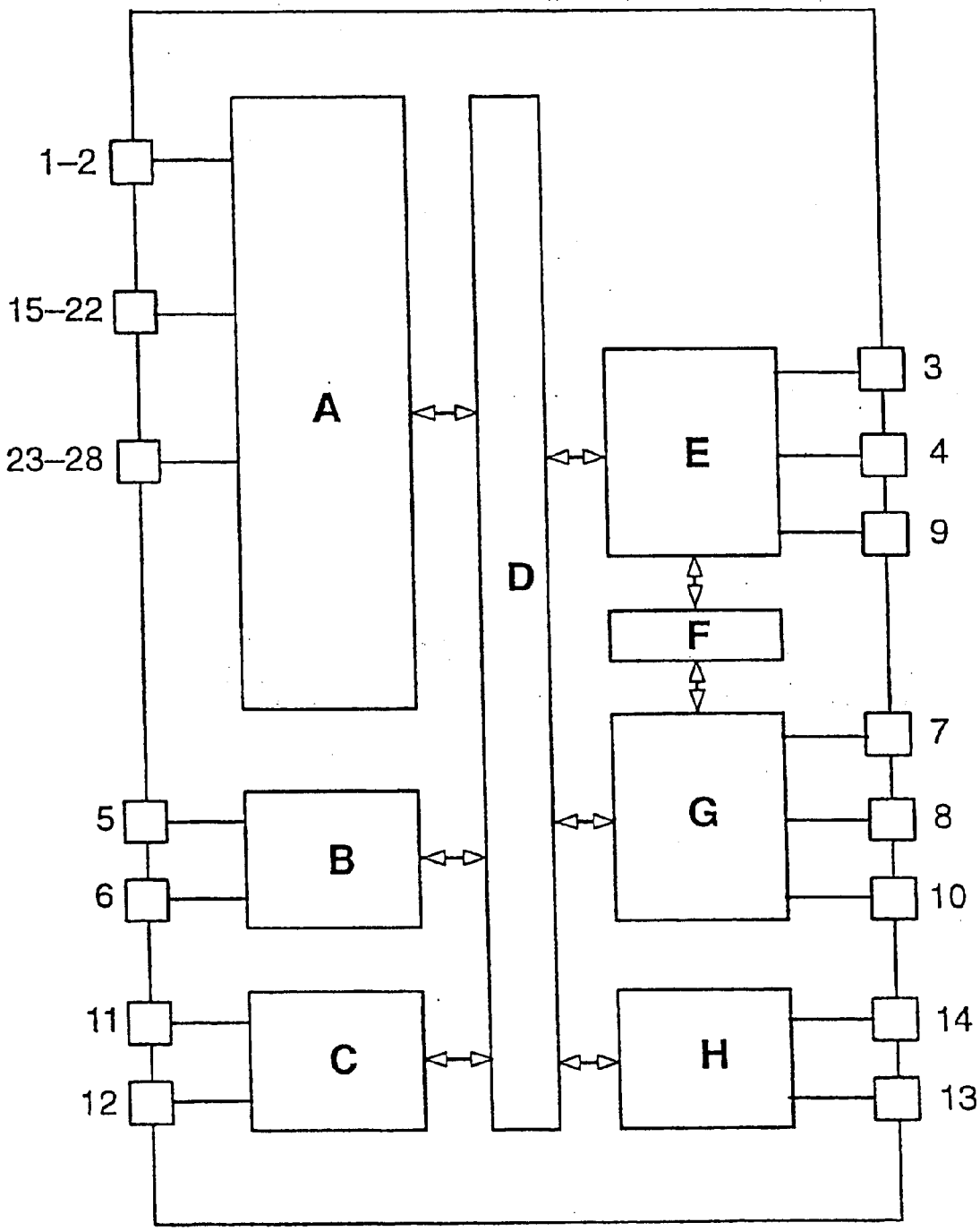
FIG. 3 shows a block diagram of the microcontroller.

The construction of the microcontroller MC is shown schematically in FIG. 3. The microcontroller MC has a clock generator, which determines the operating cycle of the microcontroller, a central processor unit, a program memory, a data memory and a mathematic unit for carrying out simple mathematical operations. The aforementioned parts of the microcontroller MC are represented by the module A in the block diagram of FIG. 3. Pins 1 and 2, 15 to 22 and 23 to 28 are associated with the module A. The quartz crystal B2 for controlling the clock generator is connected to pins 1 to 2. The operating clock frequency of the microcontroller is 8 MHz. The module B is an interface, which is used to condition the digital or analog data for the communication with the communication device DS. Pins 5 and 6 of the microcontroller MC are assigned to the module B. Module C is a 5 V voltage supply, which is connected to the capacitor C14 via pins 11 and 12 of the microcontroller MC and to the ground potential GRD. All the components of the microcontroller MC are connected to one another by the address and data bus D. The first control module E and the pins 3, 4 and 9 of the microcontroller MC which are assigned co it are used to control the transistor V1 of the step-up converter. The second control module G and the pins 7, 8 and 10 of the microcontroller MC which are assigned to it are used to control the transistors V2 and V3 of the half-bridge inverter and to control the transistor V4 of the heating device. The two control modules E, G are connected to each other via the data bus F. Module H is a 15 V voltage source, which is connected to the ground potential GRD and to the capacitor C25 via pins 13, 14 of the microcontroller MC.

Figure 4:
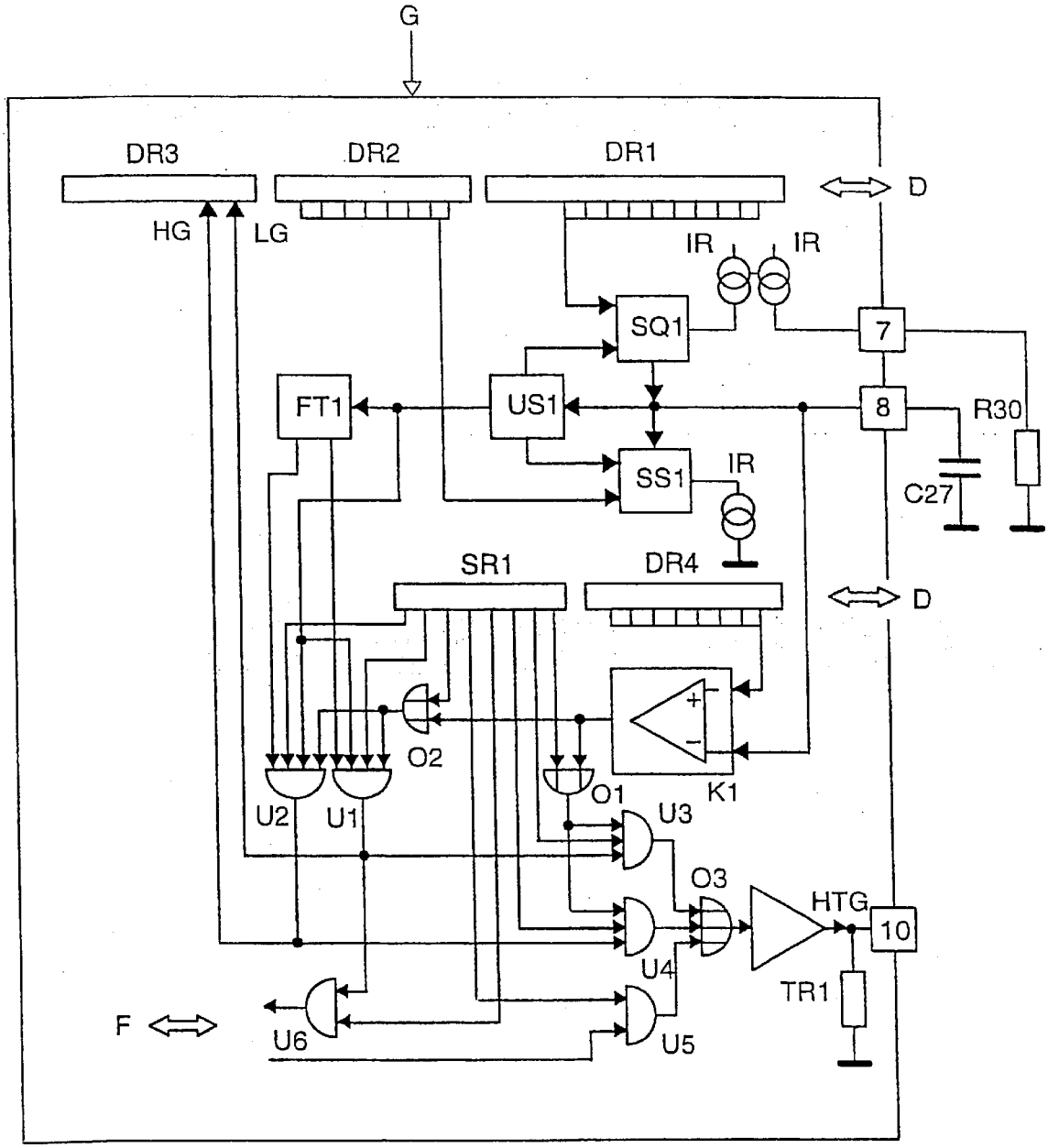
FIG. 4 shows a block diagram of the second control module G for controlling the half-bridge inverter and the heating device.

The construction of the control module G is shown schematically in the block diagram of FIG. 4. In order to control the transistors V2, V3 of the half-bridge inverter, the control module G has the controllable current source SQ1, the controllable current sink SS1, the read/write memory DR1, DR2, the switch US1 for switching the controllable current source and current sink on and off, the frequency divider FT1 for halving the frequency of the changeover signal of the switch US1, the data memory DR3 for storing the control signals for the transistors V2, V3, the reference current source IR for predefining the most constant possible reference current $I_{Ref}$ for the controllable current source SQ1 and current sink SS1, and logic circuit components O1–O3, U1–U6.

A constant output voltage of 2 V is provided on pin 7 of the microcontroller MC and, in accordance with Ohm's law, permits a constant reference current $I_{Ref}$ to flow through the resistor R30. The value of this reference current $I_{Ref}$ can be predefined by selecting the resistance value of the resistor R30. The linear working range of the reference current $I_{Ref}$ extends from 5 $\mu$A to 50 $\mu$A. The capacitor C27, which is used as an electric charge store, is connected to pin 8 of the microcontroller MC. The capacitor C27 is charged up with the aid of the controllable current source SQ1. Once the voltage drop across the capacitor C27 reaches a value of 3 V, the controllable current source SQ1 is switched off by the switch US1 and the controllable current sink is switched on, which discharges the capacitor C27. Once the voltage drop across the capacitor C27 reaches the value of 1.5 V, the controllable current sink SS1 is switched off by the switch US1 and the controllable current source SQ1 is switched on again, which charges the capacitor up again to a voltage value of 3 V. In this way, the capacitor C27 is alternately charged up and discharged. The voltage drop across the capacitor C27 therefore oscillates incessantly between the values 1.5 V and 3 V. The controllable current source SQ1 and the controllable current sink SS1 and also the switch US1 form a device for the alternate charging and discharging of the capacitor C27. The charging current for the capacitor C27, generated by the controllable current source SQ1, can be adjusted by means of the read/write memory DR1. The read/write memory DR1 is a 16-bit data register, of which 12 bits are used to control the current source SQ1. The charging current for the capacitor C27 can therefore be adjusted with a resolution of 12 bits between the values $I_{Ref}/256$ and 32 $I_{Ref}$, the abbreviation $I_{Ref}$ representing the reference current intensity of the reference current source IR. The entry in the data register DR1 determines the charging current for the actual and following charging operation on the capacitor C27, and therefore the time period which is required for this charging operation. In an analogous way, the discharging current of the capacitor C27, generated by the controllable current sink SS1, can be adjusted by means of the read/write memory DR2. The read/write memory DR2 is an 8-bit data register. The discharging current of the capacitor C27 can therefore be adjusted with a resolution of 8 bits between the values 0.25 $I_{Ref}$ and 128 $I_{Ref}$. The entry in the data register DR2 determines the discharging current for the actual and following discharging operation on the capacitor C27, and therefore the time period which is required for this discharging operation. The oscillations in the charge state of the capacitor C27 and the voltage drop across the capacitor C27 are therefore independent of the operating cycle frequency of the microcontroller MC. The changeover signals from the switch US1 are evaluated by the frequency divider FT1 and the AND gates U1, U2 in order to generate control signals for the transistors V2, V3 of the half-bridge inverter. The frequency divider FT1 detects only the switching pulses from the switch US1 which start a new charging operation of the capacitor C27, and alternately switches its two outputs, which are respectively connected to the input of an AND gate U1 and U2, alternately to "high" and "low" at each such switching pulse. The changeover signals from the switch US1 are also supplied, however, directly to the input of the AND gates U1, U2. In addition, the status register SR1 comprises a status bit to activate and deactivate the control signals for the transistor V2, and also a status bit to activate and deactivate the control signals for the transistor V3. The state of the status bit to activate and deactivate the control signals for the transistor V2 is monitored by the AND gate U2, while the state of U1. The output states of the AND gate U1 and U2 are in each case stored in one bit in the data register DR3 and can be called up via the address and data bus D on the pins 23 and 24 of the microcontroller MC. Via pin 23 and 24 of the microcontroller MC, which is connected to pin 10 and 9 of the integrated circuit IC, the output states of the AND gate U1 and U2 are communicated to the driver circuits for driving the gate electrode of the transistor V3 and V2. The frequency of the half-bridge inverter, that is to say the switching cycle of its transistors V2, V3, is controlled by the duration of the individual charging and discharging operations of the capacitor C27. This fact is to be explained in more detail below by using the graphs a) to e) of FIG. 5.

The triangular curve of graph a) shows the time variation of the voltage drop across the capacitor C27. The voltage drop across the capacitor C27 varies linearly with time between the values 1.5 V and 3 V. Graph b) shows the time variation of the charging current for the capacitor C27. The charging current can assume 4096 different discrete values, according to the above explanations relating to the controllable current source SQ1. The time variation of the discharging current for the capacitor C27 is shown in graph c). According to the above explanations relating to the controllable current sink SS1, the discharging current can assume 256 different discrete values. Graph d) shows the time variation of the control signal LG, which can be called up on pin 23 of the microcontroller MC, for the driver circuit of the transistor V3. Graph e) shows the time variation of the control signal HG, which can be called up on pin 24 of the microcontroller MC, for the driver circuit of the transistor V2. The duration of the individual charging operations on the capacitor C27 is determined by the level of the charging current IL1. The higher the charging current IL1, the lower is the time period which is required for charging the capacitor from 1.5 V to 3 V. Analogously to this, the duration of the individual discharging operations on the capacitor C27 is determined by the level of the discharging current IE1. The higher the discharging current IE1, the lower the time period which is required for discharging the capacitor from 3 V to 1.5 V. By comparing the voltage variation across the capacitor C27 from graph a) with the curves from graphs d) and e), it becomes clear that during the duration of the first, third, fifth, etc. charging operation of the capacitor C27 from 1.5 V to 3 V, the control signal LG for the transistor V3 assumes the logic state "high" and the control signal HG for the transistor V2 carries the logic state "low". During the duration of the second, fourth, sixth, etc. charging operation of the capacitor C27 from 1.5 to 3 V, on the other hand, the control signal HG for the transistor V2 assumes the logic state "high" and the control signal LG for the transistor V3 carries the logic state "low". During the duration of the discharging operations of the capacitor C27 from 3 V to 1.5 V, both control signals LG and HG assume the logic state "low". This means that the transistor V2 or V3 is switched on as long as the control signal HG or LG associated with it carries the state "high". In this way, the transistors V2, V3 of the half-bridge inverter are switched on and off alternately. During the duration of the discharging operations of the capacitor C27, both transistors V2, V3 are switched off. The evaluation of the voltage variation across the capacitor C27 in this way permits frequency-modulated control of the half-bridge inverter.

The values for the charging current IL1 and the discharging current IE1 are defined by the data stored in the data register DR1 and DR2. These data are determined under program control, with the aid of the module A, on the basis of the half wave of the alternating current component of the current in the load circuit, detected at pin 18 of the microcontroller MC, and on the current through the transistor V3, detected at pin 19. Module A of the microcontroller MC uses the comparison between the aforementioned operating parameters and predefined set points to calculate, under program control, actuating values for controlling the controllable current source SQ1 and the controllable current sink SS1, said set points being stored in the data registers DR1 and DR2. In this way, a control loop is implemented for the frequency-modulated control of the half-bridge inverter on the basis of its operating parameters and the predefined set points. The set points for the frequency-modulated control of the half-bridge inverter are determined under program control by module A of the microcontroller MC, for example on the basis of external control commands to dim the lamps LP1, LP2, which are communicated via the interfaces J3, J4 of the communication device DS and supplied to pin 5 of the microcontroller MC. The data registers DR1 to DR4 and the status register SR1 are connected to the address and data bus D.

Figure 5:
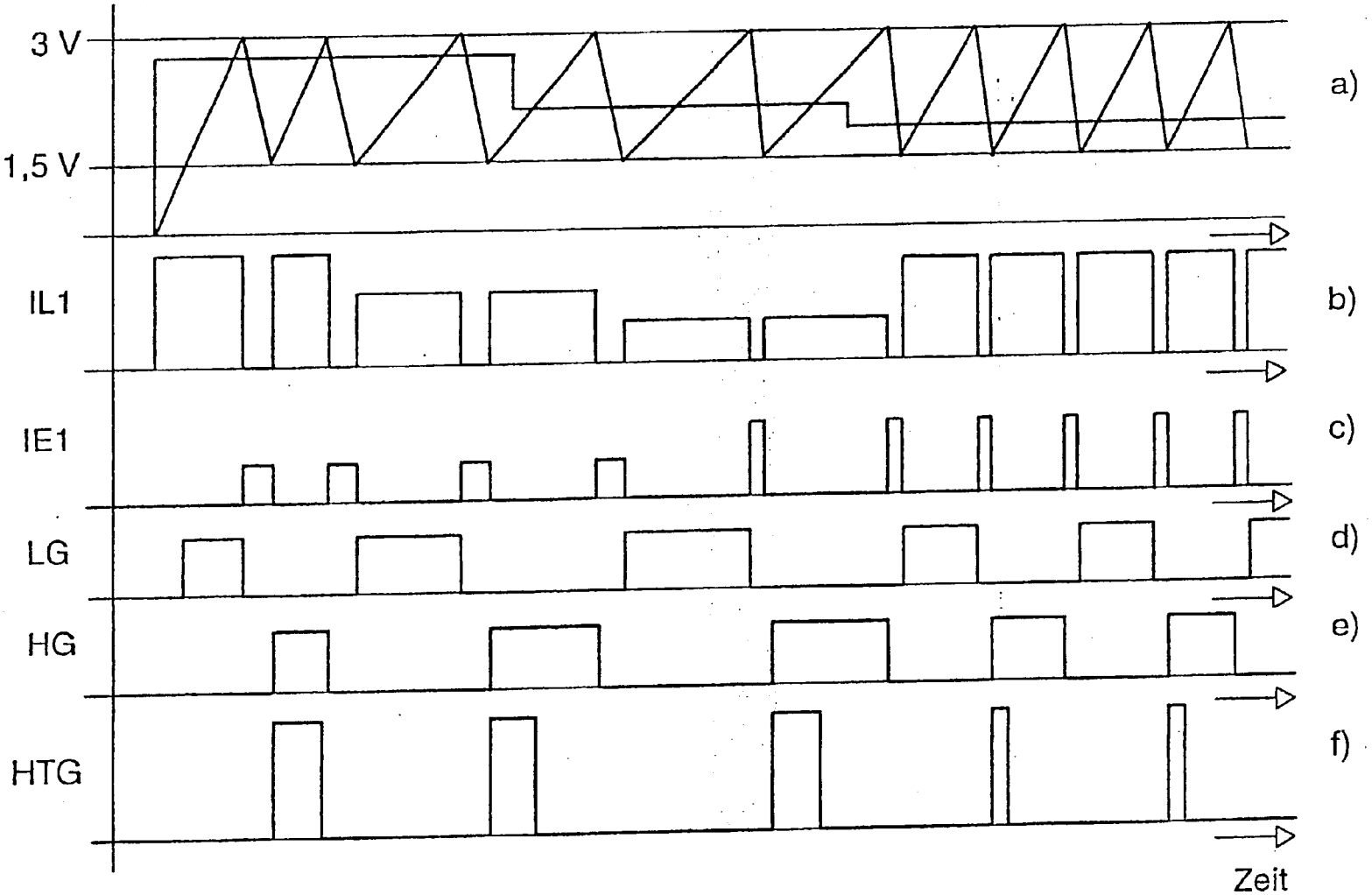
FIG. 5 shows a graph of the control signals for the inverter and the heating device.

The voltage variation across the capacitor C27, illustrated in graph a) of FIG. 5, is additionally also evaluated in order to generate pulse-width modulated control signals for the transistor V4 of the heating device for the electrode filaments E1–E4 of the lamps LP1, LP2. For this purpose, use is made of the read/write memory DR4, designed as an 8-bit data register, the comparator K1, whose inverting input detects the voltage drop across the capacitor C27 and whose non-inverting input is controlled by the data register DR4, the status register SR1 and the logic circuit components O1, O2, U3, U4, U5, O3 and the driver circuit TR1 for the transistor V4. The comparator K1 compares the voltage variation on the capacitor C27 with the actuating value stored in the data register DR4 for the regulation of the heating current. The aforementioned actuating value can be varied with a resolution of 8 bits. Accordingly, the voltage on the non-inverting input of the comparator K1 can also be varied with the same resolution in the range from 1.5 V to 3 V. The output signal from the comparator K1 is supplied via the OR gate O1 and the AND gate U3 to the OR gate O3, whose output is connected to the input of the driver circuit TR1, which drives the gate electrode of the transistor V4 via pin 10 of the microcontroller MC and the resistor R26. The output signal from the comparator K1 is additionally also supplied to the OR gate O2, whose output is connected to the AND gates U1 and U2. The output of the AND gate U1 is connected via the AND gate U3 to the OR gate O3. The output of the AND gate U2 is connected via the AND gate U4 to the OR gate O3. The 8-bit status register SR1 has a first status bit to activate and deactivate a maximum heating current, said bit being connected via the OR gate O1 and the AND gate U3 to the OR gate O3. The term maximum heating current means that the duty cycle of the transistor V4 is equal to the duty cycle of the transistor V2 or V3. The second status bit of the status register SR1, which is connected via the AND gate U3 to the OR gate O3, is used to activate and deactivate the synchronous switching-on of the transistors V3 and V4. The third status bit of the status register SR1, which is connected via the AND gate U4 to the OR gate O3, is used to activate and deactivate the synchronous switching-on of the transistors V2 and V4. The fourth status bit of the status register SR1 is connected to the AND gate U6, whose output is connected via the data bus F to the control module E. Since the output of the AND gate U1 is connected to the AND gate U6, the connection between the control signal LG and the control module E is activated and deactivated via the fourth status bit. The fifth status bit of the status register SR1 is connected via the AND gate U5 to the OR gate O3. The AND gate U5 additionally receives an input signal from the control module E via the data bus F. By means of the fifth status bit, the synchronization of the control signals for the transistors V1 and V4 can be activated and deactivated. The sixth status bit of the status register SR1, which is connected to the OR gate O2, is used to activate and deactivate the pulse-width modulation of the control signals LG and HG. The seventh and eighth status bit, which is connected to the AND gate U1 and U2, is used to activate and deactivate the control signals LG and HG for the transistors V3 and V2, and also for the transistor V4.

By means of the seventh or eighth status bit, the half-bridge inverter and the heating device can be switched off in a simple way in the event of defective lamps LP1, LP2. As has already been mentioned above, a direct current path is implemented by means of the resistor R10, the diode D9 and the appropriate secondary winding of the transformer L3, into which path the electrode filaments E1 and E3 are connected in series. If one of the lamps LP1, LP2 is missing, then this direct current path is interrupted. The current in this direct current path is monitored at pin 25 of the microcontroller MC via the resistor R14. If the abovementioned direct current path has been interrupted, then the control signal LG and HG can be switched off by resetting the seventh or eighth status bit of the status register SR1, and the half-bridge inverter can be stopped as a result.

As has already been mentioned above, rupture of the electrode filaments E2 and E4 is detected at pin 16 and 15 of the microcontroller MC via the appropriate winding of the transformer L5 and the resistor R16 or R15. In addition, the current through the lamp LP1 and LP2 or the voltage drop across the coupling capacitor C15 and C16 is monitored at pins 15 and 16 of the microcontroller MC by means of the voltage divider resistors R15, R21 and R16, R20, in order to detect the rectifying effect of the lamp LP1 or LP2 that occurs at the end of the lifetime of the lamp LP1 or LP2. The information is evaluated by the microcontroller MC and can be transmitted to an external control device via pin 6 and the communication device DS, or used to control the transistors V2, V3 and V4.

The generation of pulse-width modulated control signals for the gate electrode of the transistor V4 will be explained below using graphs a) and f) from FIG. 5. In addition to the triangular time variation of the voltage across the capacitor C27, graph a) of FIG. 5 also illustrates a staircase function, decreasing in three steps over time, which represents the actuating value for controlling the heating current that is stored in the 8-bit data register DR4. This actuating value is supplied to the non-inverting input of the comparator K1. Since, in the present exemplary embodiment, the third status bit of the status register SR1 is set, the control signals HTG and HG for the transistors V4 and V2 change simultaneously from the "low" state to the "high" state. This means that the transistor V4 is always switched on synchronously with the transistor V2 of the half-bridge inverter. The duty cycle or the turn-off time of the transistor T4, and therefore also the pulse width of the control signal HTG, depend on the output signal of the comparator K1, which compares the actuating value stored in the data register DR4 for regulating the heating current with the instantaneous voltage drop across the capacitor C27. If, during the charging operations of the capacitor C27, during which the control signal HTG is in the "high" state, the voltage across the capacitor C27 reaches the value stored in the data register DR4, then the control signal HTG changes from the "high" state to the "low" state. Since the signal present on the non-inverting input of the comparator K1 can assume only values between 1.5 V and 3 V, the pulse width of the control signal HTG is less than or equal to the pulse width of the control signal HG. This means that the duty cycle of the transistor V4 is at most exactly as long as the duty cycle of the transistor V2. In this case, the greatest possible heating current flows through the electrode filaments E1–E4. In order to build up a control loop for the heating current, the current through the transistor T4 and through the primary winding of the transformer L3 is monitored at pin 17 via the RC element R23, C18 and, under program control, is compared with a set point by means of the module A and, on the basis of the comparison, an actuating value for generating the control signal HTG is stored in the data register DR4. The requisite heating current depends on the operating state of the lamps LP1, LP2. During the preheating phase, a relatively high heating current is needed in order to permit gentle firing of the gas discharge. In addition, a heating current for the electrode filaments is also needed in the case of highly dimmed lamps LP1, LP2.

Figure 6:
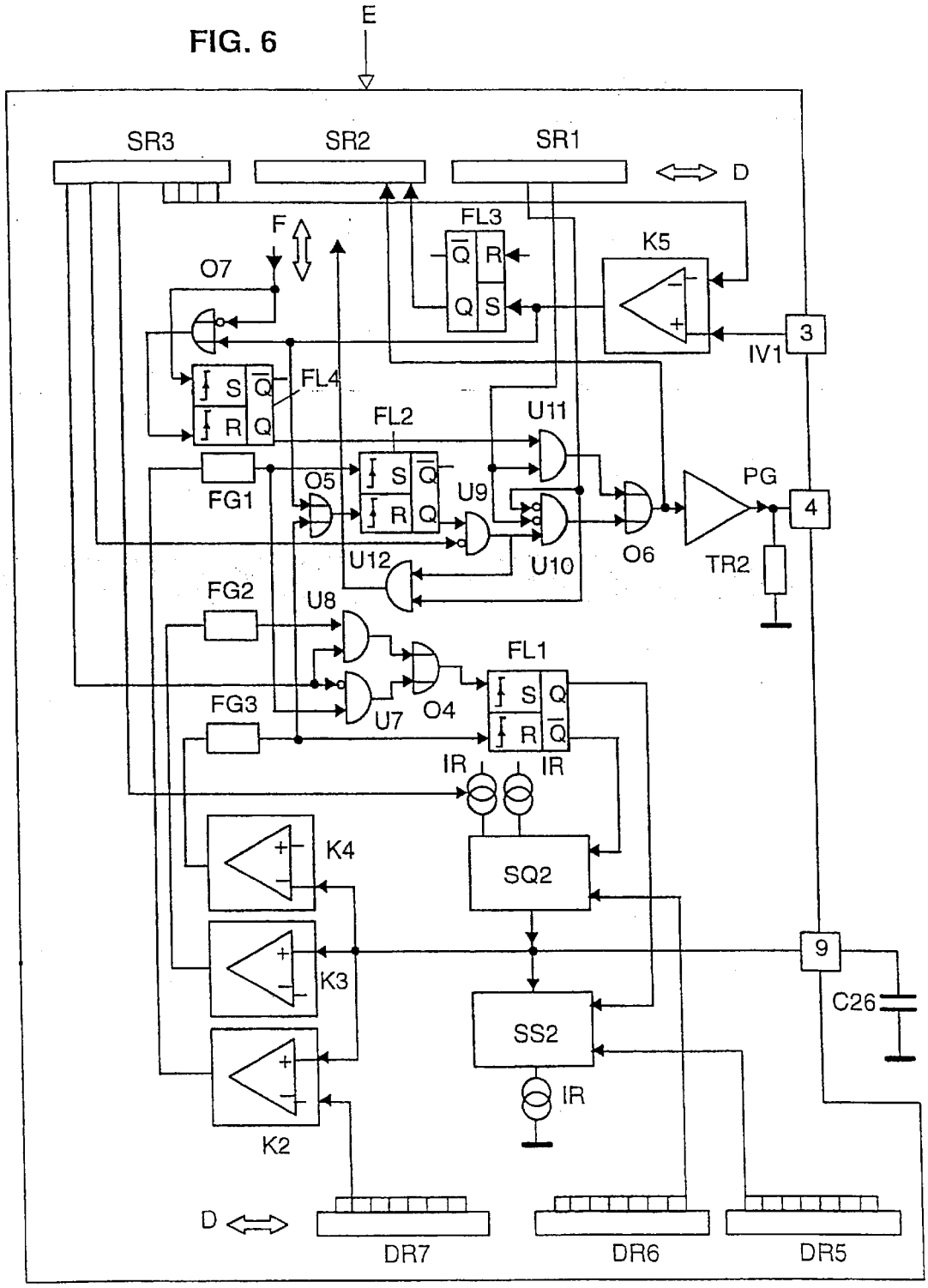
FIG. 6 shows a block diagram of the first control module E for controlling the step-up converter.

FIG. 6 illustrates schematically the construction of the control module E for controlling the transistor V1 of the step-up converter, which is used to supply DC to the half-bridge inverter connected downstream. The control module E has the controllable current source SQ2, the controllable current sink SS2, the read/write memories DR5, DR6, DR7, the status registers SR1, SR2, SR3, the comparators K2, K3, K4, K5 and the driver circuit TR2 for the transistor V1. The aforementioned components of the control module E are linked to one another by logic circuit components. The status register SR1 is the same status register which has already been described in connection with the control module G. The controllable current source SQ2 is used to charge the capacitor C26 connected to pin 9 of the microcontroller MC, and the controllable current sink SS2 is used to discharge the capacitor C26. The controllable current source SQ2 and the controllable current sink SS2 are each coupled to the reference current source IR. The charging current and the discharging current for the capacitor C26 are each adjustable with a resolution of 8 bits between the values 0.25 $I_{Ref}$ and 128 $I_{Ref}$. For this purpose, use is made of the read/write memories DR5 and DR6 each designed as 8-bit data registers. The charging current is adjusted by means of the data register DR6 and the discharging current is adjusted by means of DR5.

With the aid of the controllable current source SQ2, the capacitor C26 connected to pin 9 of the microcontroller MC is charged up to a predefinable upper voltage value, which lies in the range from 1.5 V to 3 V. When the upper voltage value is reached, the charging operation is broken off and the discharging operation of the capacitor C26 with the aid of the controllable current sink SS2 is started. When the voltage across the capacitor reaches the lower voltage value of 1.5 V, the discharging operation is broken off and a new charging operation on the capacitor C26 is started. The activation and deactivation of the controllable current source SQ2 and of the controllable current sink SS2 for the alternate charging and discharging of the capacitor C26 is carried out with the aid of the RS flip-flop FL1 and by means of the comparators K2 and K4 or, alternatively, by means of the comparators K3 and K4. The comparator K2 compares the voltage across the capacitor C26 with the upper voltage value, while the comparator K4 compares the voltage across the capacitor C26 with the lower voltage value of 1.5 V. The upper voltage value can be adjusted by means of the 8-bit data register DR7, which is connected to the inverting input of the comparator K2. Instead of the comparator K2, however, the comparator K3 can also be selected, in order to compare the voltage across the capacitor C26 with the upper voltage value. However, when the comparator K3 is used, the upper voltage value is 3 V and cannot be varied. In order to control the controllable current source SQ2 and the controllable current sink SS2 for the alternating charging and discharging operations on the capacitor C26, the outputs of the comparators K2 and K3 are connected to the set input of the RS flip-flop FL1 via the positive flank generator SG1, the AND gate U7 and the OR gate O4 or via the positive flank generator FG2, the AND gate U8 and the OR gate O4. The output of the comparator K4 is connected to the reset input of the RS flip-flop FL1 via the positive flank generator FG3. The two outputs of the RS flip-flop FL1 are connected to the controllable current source SQ2 and to the controllable current sink SS2. The controllable current source SQ2, the controllable current sink SS2, the comparators K2 (or K3) and K2 and also the RS flip-flop FL1 form a device for the alternate charging and discharging of a charge store, which alternately applies a charging current and a discharging current to the capacitor C26. The voltage across the capacitor C26 therefore oscillates incessantly between the upper and lower voltage values. This oscillation is independent of the operating cycle frequency of the microcontroller MC. The time periods which are required for charging and discharging the capacitor C26 between the upper and the lower voltage values are used, by means of the comparators K2 (or K3), K4, the positive flank generators FG1–FG3, the RS flip-flop FL2 and the logical circuit components U9–U11, O5, O6, to generate a frequency modulated and pulse-width modulated control signal PG for the input to the driver circuit TR2, which is supplied to the gate electrode of the transistor V1 via pin 4 of the microcontroller MC and the resistor R4. In addition, the control module E also comprises the comparator K5, the RS flip-flop FL3, FL4, the OR gate O7 and the status registers SR2, SR3. The status registers SR1–SR3 and the data registers DR5–DR7 are connected to the address and data bus D. With the aid of the RC element R32, C28, the current through the transistor V1 is monitored at pin 3 of the microcontroller MC. By means of the comparator K5, the OR gate O7 and the RS flip-flop FL4, the transistor V1 is protected against excessively high currents, by the control signal PG for the transistor V1 switching off if an excessively high current occurs. For this purpose, pin 3 of the microcontroller MC is connected to the non-inverting input of the comparator K5, while on the inverting input of the comparator K5 there is a reference value which, by means of the status register SR3, can be adjusted with a resolution of four bits between the values 0 V and 2 V and which defines the turn-off threshold for the control signal PG. In the event that the control signal PG is switched off by the comparator K5 and the RS flip-flop FL4, the first status bit in the status register SR2 is set by means of the RS flip-flop FL3. The second status bit in the status register SR2 is set and reset on the basis of the output signal from the OR gate O6 and indicates whether a control signal PG is present or not. The remaining six bits in the status register SR2 are unused. Of the status register SR3, the first four bits are used to drive the inverting input of the comparator K5. The fifth bit of the status register SR3 permits additional control of the reference current source IR. The sixth bit of status register SR3 is unused. With the aid of the seventh bit of the status register SR3 and of the AND gate U9, the control signal for the driver circuit TR2 and the transistor V1 can be activated and deactivated. With the aid of the eighth bit of the status register SR3 and of the AND gate U7, U8, the output signal from the comparator K2 or the comparator K3 can be activated as desired. As a result, two different operating modes for the step-up converter are made possible. If the output signal from the comparator K2 is active, the step-up converter regulates not only the supply voltage of the half-bridge inverter but is also used for power factor correction. This operating mode is preferred for the operation of discharge lamps, in particular fluorescent lamps. The other operating mode of the step-up converter is suitable for the operation of low-voltage incandescent halogen lamps on an electronic transformer which has a step-up converter to regulate the supply voltage of the inverter connected downstream. In the case of the present exemplary embodiment, the output signal from the comparator K2 is active. The control signal PG can also be made available on pin 10 of the microcontroller MC, via the AND gate U12, the data bus F and the AND gate U5, by means of the fifth status bit in the status register SR1, in order to control the transistor V4. On the other hand, the control signal LG of the control module G for controlling the transistor V3 can also be made available on pin 4 of the microcontroller MC, via the AND gate U6, the data bus F and the OR gate O7, by means of the fourth status bit in the status register SR1, in order to control the transistor V1.

Figure 7:
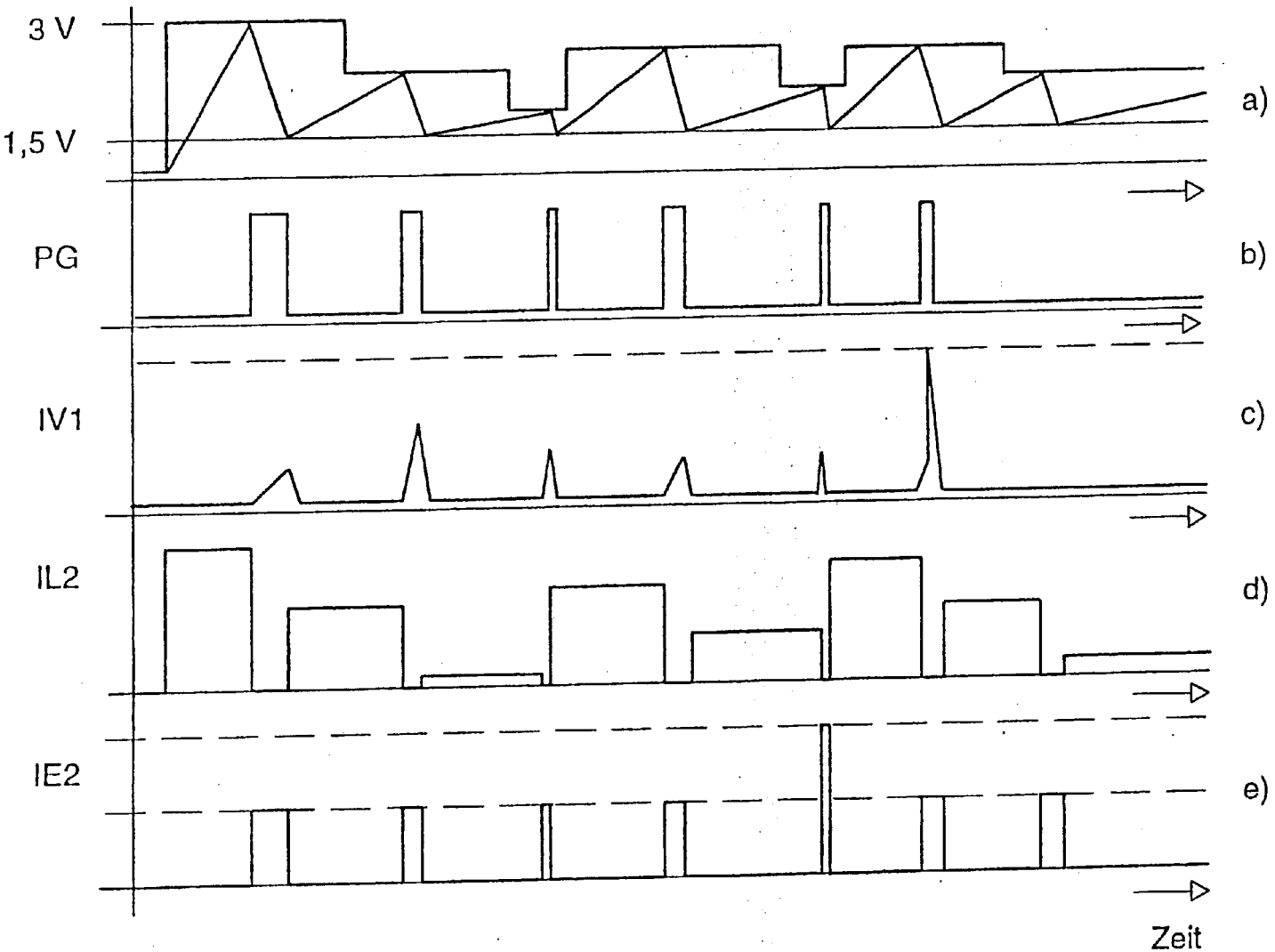
FIG. 7 shows a graph of the control signals for the step-up converter.

The generation of the control signal PG for the transistor V1 will be explained in more detail below by using FIG. 7. The triangular curve in graph a) of FIG. 7 represents the variation over time of the voltage across the capacitor C26. The step-like curve in graph a) of FIG. 7 represents the time variation of the memory content of the data register DR7, which can assume values between 1.5 V and 3 V with a resolution of eight bits. Graph b) illustrates the variation over time of the control signal PG for the gate electrode of the transistor V1, which can be called up on pin 4 of the microcontroller MC. Graph c) of FIG. 7 shows the time variation of the signal generated on pin 3 of the microcontroller MC by means of the RC element R32, C28 in order to monitor the current through the transistor V1. Graph d) shows the time variation of the charging current for the capacitor C26, generated by the controllable current source SQ2, and graph e) of FIG. 7 shows the time variation of the discharging current for the capacitor C26, generated by the controllable current sink SS2. The capacitor C26 is alternately charged up to an upper voltage value, which is determined by the memory content of the data register DR7, and discharged down to a lower voltage value of 1.5 V. The duration of the individual charging operations of the capacitor C26 is therefore defined by the upper voltage value and by the charging current IL2, which can be adjusted by means of the data register DR6. In a corresponding way, the duration of the individual discharging operations is determined by the upper voltage value and the discharging current IE2, which can be adjusted by means of the data register DR5. The time periods which are required for the alternate charging and discharging of the capacitor C26 are evaluated, by means of the above-described logical circuit components of the control module E, in order to generate the frequency modulated and pulse-width modulated control signal PG. The comparison of the voltage variation across the capacitor C26, illustrated in graph a), with the control signal PG depicted in graph b) shows that the transistor V1 is switched off during the charging operations on the capacitor C26 and is switched on during the discharging operations on the capacitor C26. Once the signal IV1 (graph c) of FIG. 7), detected on pin 3 of the microcontroller, reaches the threshold set at the inverting input of the comparator K5, the control signal PG is deactivated.

As has already been described above, the voltage across the capacitor C2 is monitored on pin 20 of the microcontroller MC, and the voltage across the capacitor C3 is monitored on pin 21 of the microcontroller MC. From these values, by means of the module A of the microcontroller MC, the current through the step-up converter inductor L2 can be calculated and, on the basis of these operating parameters, with the aid of the program implemented in module A, the memory contents of the data registers DR5, DR6 and DR7 can be determined in order to generate the control signal PG for the transistor V1. In this way, a control loop for controlling the transistor V1 is implemented.

The invention is not restricted to the exemplary embodiments described in detail above. For example, the invention can also be used to control the switching transistors of ballasts for the operation of high-pressure discharge lamps, and also of electronic transformers for the operation of low-voltage incandescent halogen lamps. In particular, it is also possible, by means of the device according to the invention for the alternate charging and discharging of a charge store, designed as a constituent part of a microcontroller, to generate the frequency modulated or pulse-width modulated control signals for the switching transistors of a full-bridge inverter or of a push-pull inverter.

What is claimed is:

1. A microcontroller having at least one device (E, G) for controlling a switched-mode power supply, characterized in that the at least one device (E, G) has a device (SQ1, SS1; SQ2, SS2) for the alternate charging and discharging of a charge store (C27; C26) that can be connected to the microcontroller (MC) or integrated into the microcontroller (MC), wherein the device (SQ1, SS1; SQ2, SS2) has:

(i) a controllable current source (SQ1; SQ2) for applying an adjustable charging current to the charge storage capacitance (C27; C26); and (ii) a controllable current sink (SS1; SS2) for applying an adjustable discharging current to the charge storage capacitance (C27; C26), control means for the device (SQ1, SS1; SQ2, SS2) for controlling the charging operations and the discharging operations, and evaluation means which are used to evaluate the time periods required for recharging the charge storage capacitance (C27; C26) between different charge states and, on this basis, to generate at least one of: (i) a pulse-width modulation control signal; and (ii) a frequency control signal.

2. The microcontroller as claimed in claim 1, characterized in that the adjustments of the controllable current source (SQ1; SQ2) and of the controllable current sink (SS1; SS2) can be varied in relation to a reference current level that can be predefined by means of a reference current source (IR), in each case with a resolution of at least 8 bits.

3. The microcontroller as claimed in claim 2, characterized in that the reference current level for the charging and the discharging current can be predefined by means of a nonreactive resistor (R30).

4. The microcontroller as claimed in claim 1, characterized in that the control means for the device (SQ1, SS1; SQ2, SS2) for the alternate charging and discharging of the charge storage capacitance have at least one read/write memory (DR1, DR2; DR5, DR6).

5. The microcontroller as claimed in claim 1, characterized in that the control means of the device (SQ1, SS1; SQ2, SS2) for the alternate charging and discharging of the charge storage capacitance have switching means (US1; FL1) which are used to switch over the device (SQ1, SS1; SQ2, SS2) from charging to discharging of the charge storage capacitance (C27; C26) when a first voltage value is reached, and to switch over this device (SQ1, SS1; SQ2, SS2) from discharging to charging of the charge storage capacitance (C27; C26) when a second, lower voltage value is reached.

6. The microcontroller as claimed in claim 5, characterized in that the first voltage value or second voltage value can be adjusted by means of a read/write memory (DR7).

7. The microcontroller as claimed in claim 1, characterized in that a frequency divider (FT1) or a pulse divider is provided which, at its input, detects the changeover of the device (SQ1 SS1; SQ2, SS2) for the alternate charging and discharging of a charge storage capacitance from discharging to charging or from charging to discharging, and divides the input signal into signals for the alternating control of alternately switching means (V2, V3) of the switched-mode power supply.

8. The microcontroller as claimed in claim 1, characterized in that the microcontroller (MC) has interfaces (1–28) for registering external signals or data and a device (A) for evaluating the external signals or data and for the program-controlled determination of actuating values for controlling the device (SQ1, SS1; SQ2, SS2) for the alternate charging and discharging of the charge storage capacitance.

9. A ballast for operating at least one electric lamp (LP1, LP2), which has an inverter, at least one load circuit coupled to the inverter and having terminals (X1–X8) for the at least one electric lamp (LP1, LP2), a control circuit for controlling the switching means (V2, V3) of the inverter and a DC supply circuit for the inverter, the control circuit comprising a microcontroller (MC) having a device (G) for controlling the switching means (V2, V3) of the inverter, characterized in that the device (G) for controlling the switching means of the inverter has a device (SQ1, SS1) for the alternate charging and discharging of a first charge storage capacitor (C27), control means for this device (SQ1, SS1) for controlling the charging operations and the discharging operations, and evaluation means which are used to evaluate the duration of the alternate charging and discharging operations of the first charge storage capacitor (C27) and on this basis to generate one of: (i) a frequency control signal; and (ii) a pulse-width modulation control signal for controlling the switching means (V2, V3) of the inverter, and wherein the ballast further comprises a frequency divider (FT1) or a pulse divider which: (i) at its input, detects the changeover of the device (SQ1, SS1) for the alternate charging and discharging of the first charge storage capacitor from discharging to charging or from charging to discharging; and (ii) divides the input signal into signals for the alternating control of the switching means (V2, V3) of the inverter.

10. The ballast as claimed in claim 9, characterized in that the ballast has a hearing device equipped with a controllable switching means (V4) to apply a hearing current to the lamp electrodes (E1–E4) of the at least one electric lamp (LP1, LP2) and the microcontroller (MC) has a comparator (K1), which compares the charge state of the first charge storage capacitor (C27) with a reference value for the lamp electrode heating and which is used to generate a control signal for the pulse-width modulation of the controllable switching means (V4) of the heating device.

11. The ballast as claimed in claim 10, characterized in that the reference value can be adjusted by means of a read/write memory (DR4).

12. The ballast as claimed in claim 10, characterized in that the microcontroller (MC) has synchronization means (SR1) for synchronizing the controllable switching means (V4) of the heating device with a switching means (V2) of the inverter.

13. The ballast as claimed in claim 9, characterized in that the DC supply circuit has a step-up converter for power factor the microcontroller (MC) has a second device (SQ2, SS2) for the alternate charging and discharging of a second charge storage capacitor (C26), the microcontroller (MC) has second control means for this second device (SQ2, SS2) for controlling the charging operations and the discharging operations, and the microcontroller (MC) has second evaluation means which are used to evaluate the time periods required for recharging the second charge storage capacitor between different charge states and, on this basis, to generate at least one of: (i) a pulse-width modulation control signal; and (ii) a frequency control signal for the controllable switching means (V1) of the step-up converter.

14. The ballast as claimed in claim 13, characterized in that the second evaluation means have a first comparator (K2, K3) to compare the charge state of the second charge storage capacitor (C26) with a first voltage value, and a second comparator (K4) to compare the charge state of the second charge storage capacitor (C26) with a second, lower voltage value, and in that the second control means of the second device (SQ2, SS2) have switching means (FL1) which are used to switch over the second device (SQ1, SS1; SQ2, SS2) from charging to discharging of the second charge storage capacitor (C26) when the first voltage value is reached, and to switch over the second device (SQ2, SS2) from discharging to charging of the second charge storage capacitor (C26) when the second, lower voltage value is reached.

15. The ballast as claimed in claim 14, characterized in that the first voltage value or the second voltage value can be adjusted by means of a read/write memory (DR7).

16. The ballast as claimed in claim 13, characterized in that the devices (SQ1, SS1; SQ2, SS2) for the alternate charging and discharging of the first and second charge storage capacitors each have a controllable current source (SQ1; SQ2) for applying an adjustable charging current to the first charge storage capacitor (C27) and, respectively, the second charge storage capacitor (C26), and in each case a controllable current sink (SS1; SS2) for applying an adjustable discharging current to the first charge storage capacitor (C27) and, respectively, the second charge storage capacitor (C26).

17. The ballast as claimed in claim 16, characterized in that the settings of the controllable current sources (SQ1; SQ2) and of the controllable current sinks (SS1; SS2) can be varied in relation to a reference current level (IR), in each case with a resolution of at least 8 bits.

18. The ballast as claimed in claim 17, characterized in that the reference current level (IR) for the charging current and the discharging current can be predefined by means of a nonreactive resistor (R30).

19. The ballast as claimed in claim 9, characterized in that the microcontroller (MC) has interfaces (18, 19; 15, 16; 20, 21, 3) for registering operating parameters of at least one of: (i) the inverter; (ii) the at least one electric lamp (LP1, LP2); and (iii) the step-up converter, wherein the microcontroller further has a program-controlled device (A) which is used to evaluate the operating parameters and to determine at least one of: (i) actuating values for controlling the devices (SQ1, SS1; SQ2, SS2) for the alternate charging and discharging of the first and second charge storage capacitors; (ii) the reference value for the lamp electrode heating; and (iii) the first or second voltage value.

20. The ballast according to claim 9, characterized in that the ballast has terminals (J3, J4) and means (DS) for communication with an external control device, and the microcontroller (MC) has interfaces (5, 6) which are coupled to the terminals (J3, J4).

21. A method of operating at least one electric lamp (LP1, LP2) with the aid of a ballast which has an inverter with a control circuit containing a microcontroller (MC) for the switching means (V2, V3) of the inverter and has at least one load circuit coupled to the inverter and having terminals (X1–X8) for the at least one electric lamp (LP1, LP2), characterized in that, with the aid of the microcontroller (MC)

a charge storage capacitor (C27) has a charging current and a discharging current alternately applied to it, the duration of the alternate charging and discharging operations of the charge storage capacitor (C27) is evaluated and on this basis a control signal for the alternating control of the switching means (V2, V3) of the inverter is generated, the lamp electrodes (E1–E4) of the at least one electric lamp (LP1, LP2) have a heating current applied to them, the heating current being regulated by means of a controllable switching means (V4), by pulse-width modulated control signals being generated for the controllable switching means (V4) with the aid of a comparator (K1), which compares the charge state of the charge storage capacitor (C27) with a reference value for the lamp electrode heating.

22. The method as claimed in claim 21, characterized in that the reference value is adjusted on the basis of the desired heating power and stored in a read/write memory (DR4) of the microcontroller (MC).

23. The method as claimed in claim 21, characterized in that the controllable switching means (V4) for regulating the heating current are switched on synchronously with a switching means (V2) of the inverter, and the duty cycle of the controllable switching means (V4) for regulating the heating current is smaller than or equal to the duty cycle of the switching means (V2) of the inverter.

24. A method of operating at least one electric lamp (LP1, LP2) with the aid of a ballast which has an inverter with a control circuit containing a microcontroller (MC) for the switching means (V2, V3) of the inverter and has at least one load circuit coupled to the inverter and having terminals (X1–X8) for the at least one electric lamp (LP1, LP2), characterized in that, with the aid of the microcontroller (MC)

a charge storage capacitor (C27) has a charging current and a discharging current alternately applied to it, the duration of the alternate charging and discharging operations of the charge storage capacitor (C27) is evaluated and on this basis a control signal for the alternating control of the switching means (V2, V3) of the inverter is generated, the direct current for the power supply of the inverter is regulated by means of a step-up converter, in order to ensure power factor correction a control signal for the controllable switching means (V1) of the step-up converter being generated with the aid of the microcontroller (MC), by a second charge storage capacitor (C26) being recharged between different charge states, and the time periods for recharging the second charge storage capacitor (C26) being evaluated in order to generate the the control signal for the controllable switching means (V1) of the step-up converter.

25. The method as claimed in claim 24, characterized in that, with the aid of a first comparator (K2, K3), the charge state of the second charge storage capacitor (C26) is compared with a first voltage value and, with the aid of a second comparator (K4), the charge state of the second charge storage capacitor (C26) is compared with a second, lower voltage value, the charging operation of the second charge storage capacitor C26) being terminated and the discharging operation of the second charge storage capacitor (C26) being started when the first voltage value is reached, and the discharging operation of the second charge storage capacitor (C26) being terminated and the charging operation being started when the second, lower voltage value is reached.

26. The method as claimed in claim 25, characterized in that at least one of the first voltage value and the second voltage value is adjusted by means of a read/write memory (DR7).

27. The method as claimed in claim 24, characterized in that the charging current is generated by means of a current source (SQ1; SQ2), and the current intensity is adjusted by means of a read/write memory (DR1; DR6).

28. The method as claimed in claim 24, characterized in that the discharging current is generated by means of a current sink (SS1; SS2), and the current intensity is adjusted by means of a read/write memory (DR2; DR5).

29. The method as claimed in claim 24, characterized in that, with the aid of the microcontroller (MC), actual values of operating parameters of at least one of: (i) the inverter; (ii) the at least one electric lamp (LP1, LP2); and (iii) the DC supply circuit of the inverter are monitored and are evaluated, wherein the actual values of operating parameters are monitored and evaluated in order to: (a) control the charging or discharging operations of the first and second charge storage capacitors (C27; C26); (b) determine the reference value for the lamp electrode heating; and (c) determine the first voltage value and the second voltage value.

* * * * *